US005678890A

United States Patent [19]

Tenbroeck

[11] Patent Number: 5,678,890

[45] Date of Patent: Oct. 21, 1997

[54] PVC PIPE ROCKING CHAIR

[76] Inventor: Randy L. Tenbroeck, 1209 Cadillac Dr., Daytona Beach, Fla. 32117

[21] Appl. No.: 734,526

[22] Filed: Oct. 21, 1996

[51] Int. Cl.[6] ..... A47C 3/02

[52] U.S. Cl. ..... 297/271.6; 297/451.13; 297/452.13; 297/DIG. 2; 297/440.11; 297/452.2

[58] Field of Search ..... 297/DIG. 2, 452.2, 297/440.14, 440.24, 451.13, 271.6, 452.6, 452.13, 440.11

[56] References Cited

U.S. PATENT DOCUMENTS

| | | | |
|---|---|---|---|
| D. 283,565 | 4/1986 | Wilson | D6/348 |
| 2,688,997 | 9/1954 | Miller | 297/233 X |
| 2,710,027 | 6/1955 | Husgen et al. | 297/440.24 X |
| 2,797,738 | 7/1957 | Patterson | 155/88 |
| 3,072,435 | 1/1963 | Komulainen | 297/271.6 |
| 3,497,258 | 2/1970 | Hill | 297/183 |
| 3,556,586 | 1/1971 | Beardmore | 297/451.13 X |
| 3,695,702 | 10/1972 | Ingellis | 297/441 |
| 3,719,389 | 3/1973 | Burton et al. | 297/440 |
| 4,119,286 | 10/1978 | Barril | 248/188 |
| 4,285,543 | 8/1981 | Clark | 297/272 |
| 4,469,377 | 9/1984 | O'Rourke | 297/464 |
| 4,997,234 | 3/1991 | Royle et al. | 297/440.24 X |
| 5,364,161 | 11/1994 | Liu | 297/195 |
| 5,423,592 | 6/1995 | Spurrier et al. | 297/440.24 X |
| 5,429,417 | 7/1995 | Kim | 297/440.24 X |
| 5,536,063 | 7/1996 | Cable | 297/45 X |
| 5,599,068 | 2/1997 | Kelly et al. | 297/DIG. 2 X |

*Primary Examiner*—Milton Nelson, Jr.
*Attorney, Agent, or Firm*—Edward M. Livingston, Esq.

[57] ABSTRACT

A rocking chair having two identical side frames (40*a,b*) made of a plurality of tubular members connected together by joint members, each of the side frames being attached to and separated from each other by tubular front seat (4) back seat (5) and head rest (3) rail members. At the bottom of each frame is a curved rocking member (1*a,b*) with T-joint members (7*a, b;* 19*a,b*) at each end to form a safe rocking surface not prone to tipping. All tubular members and joint members are preferably made of PVC to provide a light-weight rocking chair for easy carrying even by small children. The use of PVC also results in a rocking chair that is durable, resistant to the elements and inexpensive. A seat (20) and back (21), preferably made of fabric suspended between the front and back seat rails and back seat and head rest rails, respectively, is provided.

9 Claims, 3 Drawing Sheets

PVC PIPE ROCKING CHAIR

BACKGROUND OF THE INVENTION

This invention relates to furniture and more particularly, a rocking chair made of polyvinyl chloride (PVC) tubular members.

Most rocking chairs are heavy, usually being made of wood or metal, and as such cannot be easily carried or transported. Also, rocking chairs are relatively expensive compared to other types of chairs or furniture. Furthermore, most rocking chairs are not designed for outdoor use or exposure to the elements, such as sun and rain. In addition, many rocking chairs are prone to tipping over, particularly when used by children. The latter fact explains why there are very few safe rocking chairs for children.

Thus, a need exists for a rocking chair that addresses the above problems of cost, lack of durability, resistance to the elements and safety.

The prior art includes some patents for furniture, even some rocking chairs for children, but none is like the present invention. For instance, U.S. Pat. No. 3,719,389 issued to Burton et al. on Mar. 6, 1973 shows some furniture made of PVC tubing, but not a rocking chair like the present invention. U.S. Pat. No. 4,469,377 issued to O'Rourke on Sep. 4, 1984 teaches a reclining seat made of PVC tubing. U.S. Pat. No. 4,119,286 issued to Barril on Oct. 10, 1978 discloses more furniture made of PVC tubing, but none like the present invention. U.S. Des. Pat. No. 283,565 issued to Wilson on Apr. 29, 1986 teaches the design for a child's rocking chair, but it is not made of PVC and has a different construction than the present invention. U.S. Pat. No. 5,364,161 issued to Liu on Nov. 15, 1994 teaches an inflatable rocking chair. U.S. Pat. No. 3,497,258 issued to Hill on Feb. 24, 1970 teaches a rocking toy for children, but none like the present invention. U.S. Pat. No. 2,797,738 issued to Patterson on Jul. 2, 1957 discloses an adjustable size rocking chair. U.S. Pat. No. 3,695,702 issued to Ingellis on Oct. 3, 1972 discloses furniture made of PVC tubing, but none like the present invention. Finally, U.S. Pat. No. 4,285,543 issued to Clark on Aug. 25, 1981 teaches an attachment to convert a lawn chair into a rocking chair.

Although many of the above patents do teach furniture made of PVC tubing, none of the patents discloses a rocking chair having the structure and features of the present invention.

SUMMARY OF THE INVENTION

One object of the present invention is to provide a lightweight rocking chair for easy carrying, even by small children.

Another object of the present invention is to provide such a rocking chair which is safe, in that it is not prone to tipping.

A further object of the present invention is to provide such a rocking chair that is durable.

An ancillary object of the present invention is to provide such a rocking chair that is resistant to the elements.

An even further object of the present invention is to provide a rocking chair that is inexpensive.

A primary object of the present invention is to provide a rocking chair that is most suitable for use by a child.

The present invention fulfills the above and other objects by providing a rocking chair made of a pair of parallel side frames connected together and separated a desired space by at least three tubular rails—one in the front of the seat, one for the back of the seat and one for the headrest. Each frame is made of a plurality of tubular members connected by joints and has a curved, tubular rocking member on the bottom. The rocking member has T-joint members attached to each end with one opening pointing upward and a second outward. The outward opening may have a cap placed thereon. The T-joint members are particularly designed to prevent tipping of the rocking chair as they extend the length of the rocking member and also provide a ridge which prevents tipping. Upright tubular members are secured in the upward openings on the joint members. These upright tubular members would preferably be curved inward. In turn, a T-joint member is attached to the top of each said upright tubular members in a manner such that its middle opening is directed perpendicularly inward and the remaining end opening faces upright.

A relatively short tubular member is inserted in the end opening of each T-joint member. There in the front short tubular an elbow member is inserted and in the back short tubular members a T-joint member with one opening directed toward the middle and its middle opening directed perpendicularly toward the front elbow member.

Another tubular member is inserted in the opening of the third T-joint member in the back of the frame. A tubular area member connects to the T-joint member and the front elbow member. An elbow is inserted on the tubular member with an opening directed perpendicularly inward into which a head rail member is inserted. A seat preferably made of fabric can be connected between the back and front seat members and also a back preferably made of fabric can be connected between the back seat member and the head rail member. The T-joint member in the rocking members will preferably have caps on the end openings.

Although the rocking chair of this invention can be made of a plurality of tubular members and joint members as discussed above, the members could be molded together into a one piece integral chair. The tubular members of this rocking chair could be made of almost any material, but preferably it would be made of polyvinyl chloride (PVC) for its lightweight and durable qualities.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENT

Figure 1:
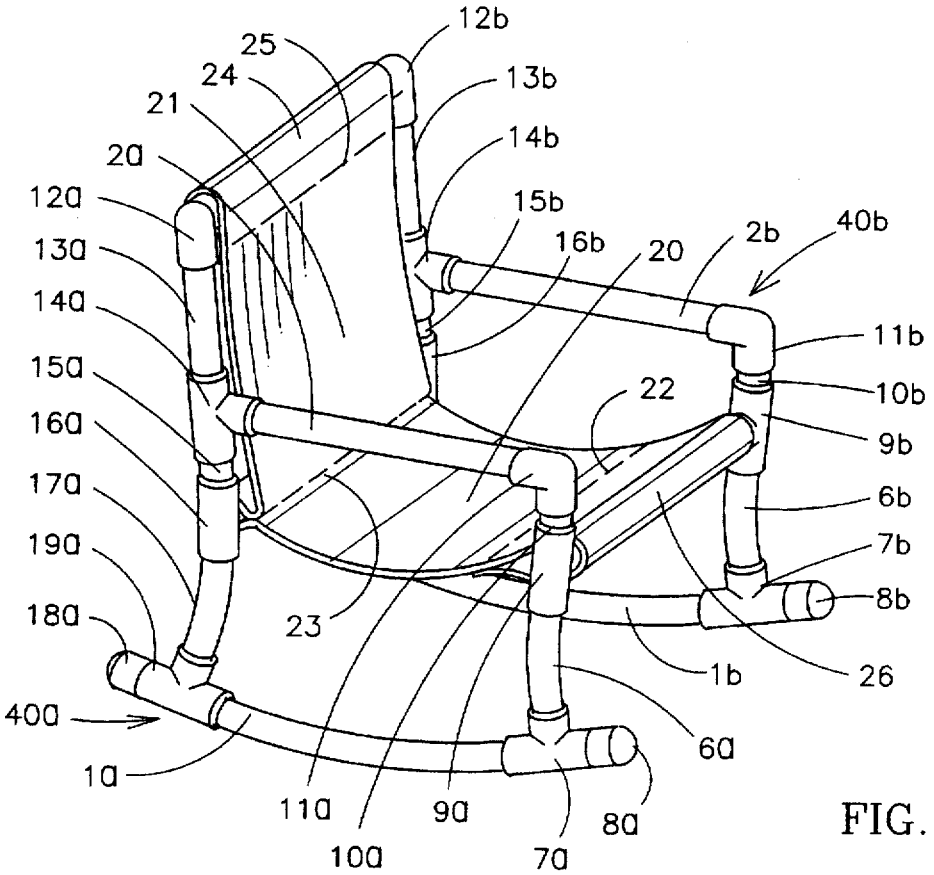
FIG. 1 is a perspective view showing a completely assembled rocking chair with seat in back.
Figure 2:
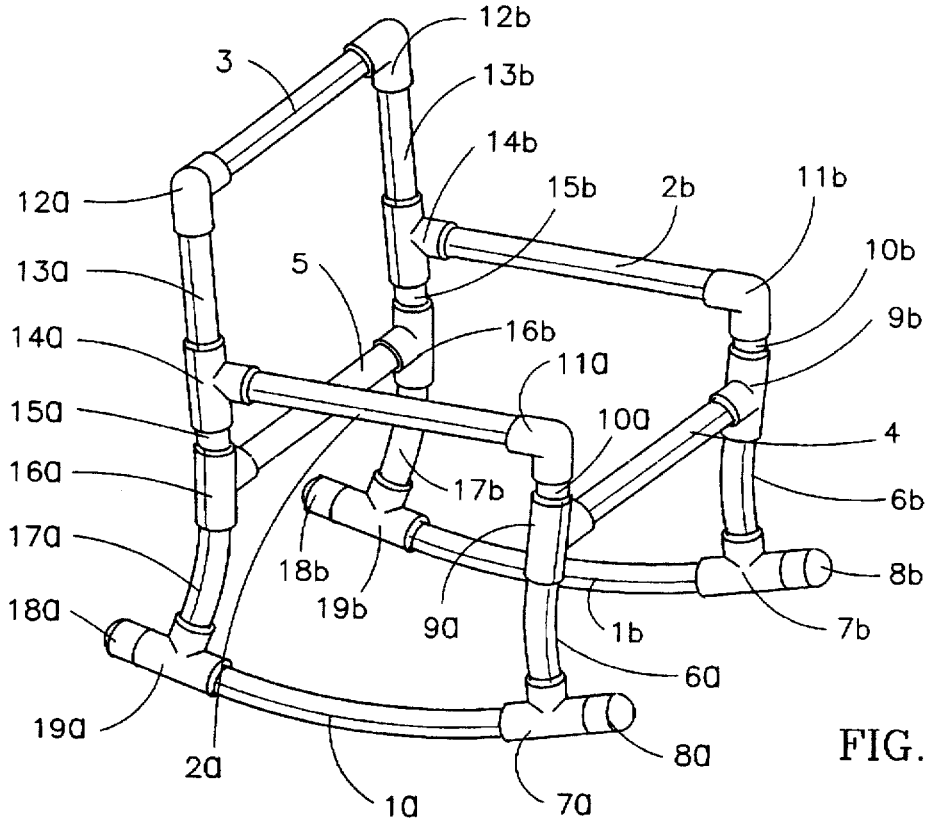
FIG. 2 is a perspective view showing the tubular skeleton of the rocking chair.
Figure 3:
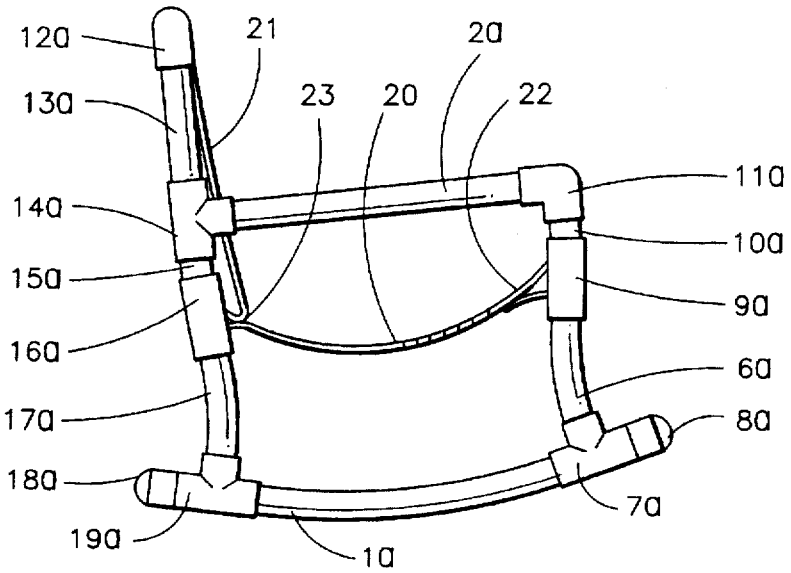
FIG. 3 is a side view of the rocking chair with a seat in back.
Figure 4:
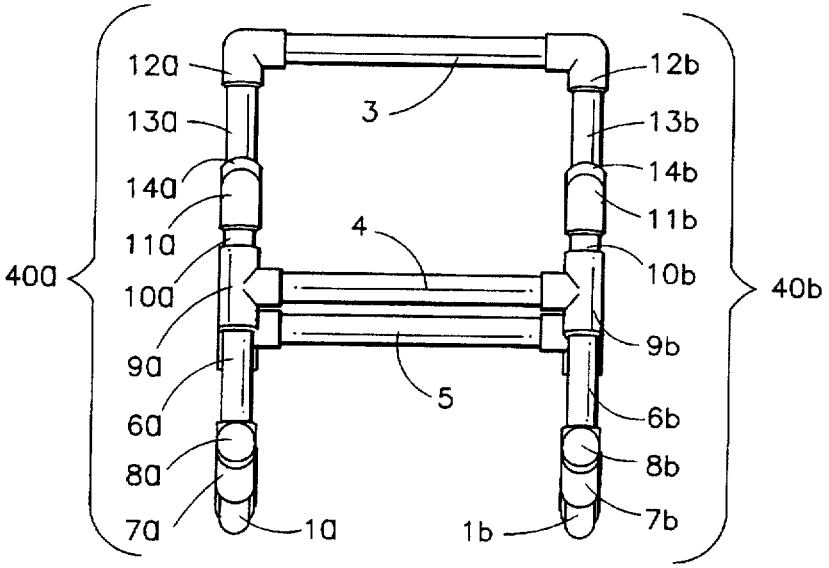
FIG. 4 is a front view of the rocking chair showing the tubular skeleton of the rocking chair.
Figure 5:
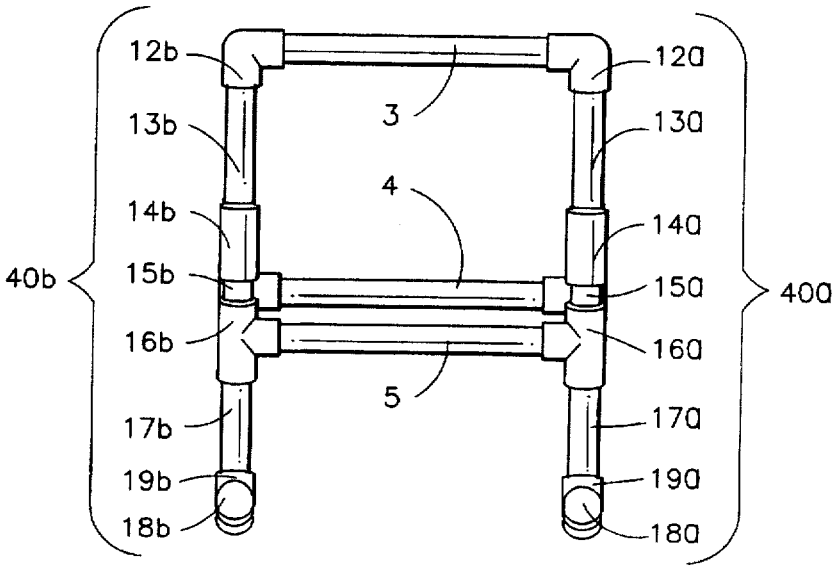
FIG. 5 is a back view of the rocking chair showing the tubular skeleton.
Figure 6:
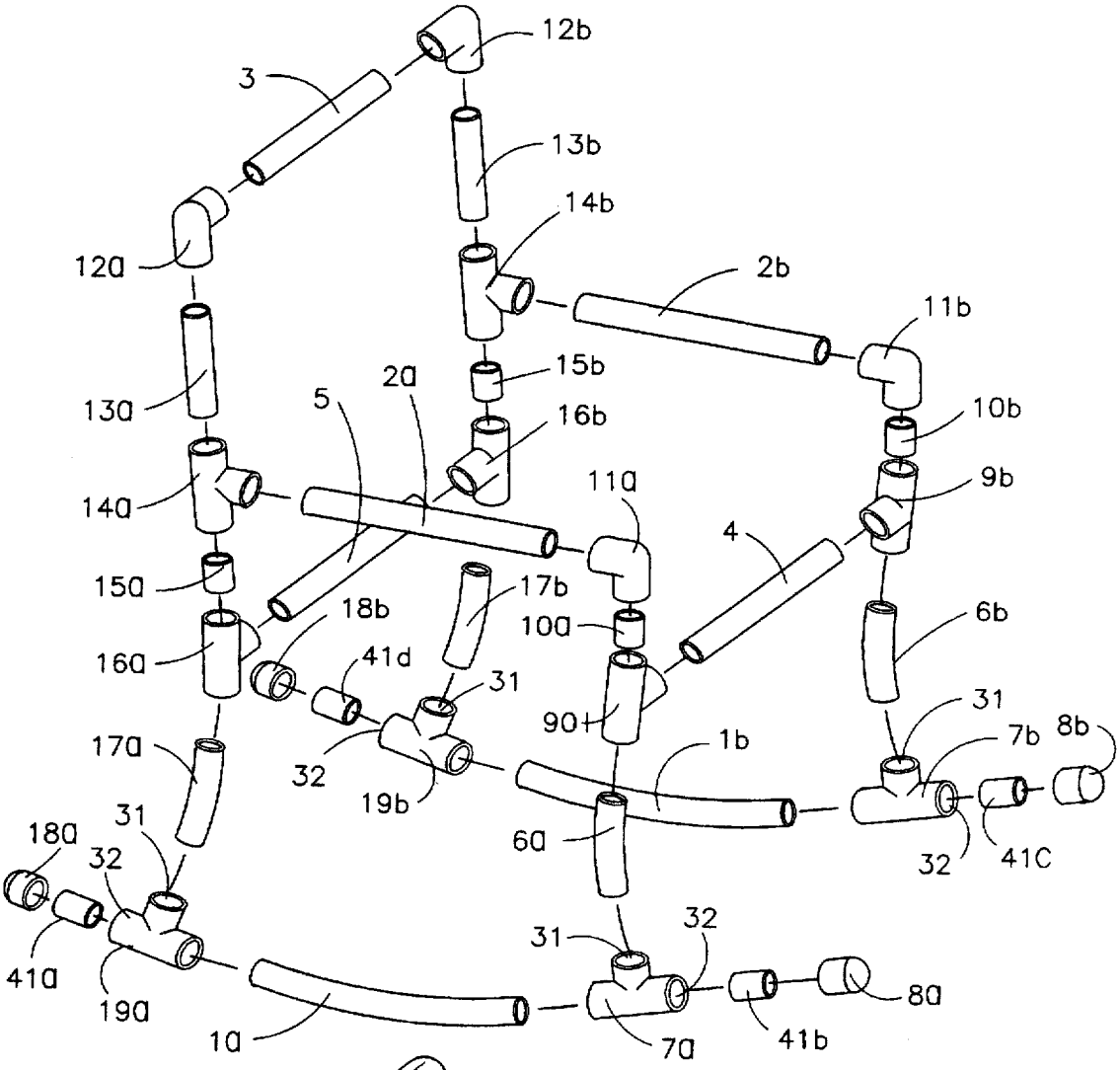
FIG. 6 is a perspective exploded view of the rocking chair showing the members before assembly.

Referring now to the drawings, FIGS. 1–6 illustrate the tubular members and joint members used to construct the rocking chair of the present invention. FIGS. 1 and 3 also show the fabric seat and back in place on the invention.

The rocking chair of this invention is made of two identical side frames 40*a* and 40*b* which are spaced apart a select distance and maintained parallel to each other by interconnecting tubular members 3, 4 and 5. Each frame member 40*a* and 40*b* has a curved rocking member 1*a*, 1*b* at the bottom thereof. This curved rocking member is formed from a straight tubular member made of PVC which is heated and then bent to produce the desired curve. At each end of the rocking members 1*a* and 1*b* is a T-joint 7*a*, 7*b* at the front and 19*a*, 19*b* at the back end thereof. Each T-joint member 7*a*, 7*b* and 19*a*, 19*b* has its side perpendicular opening 31 facing upward. The end openings 32 on each of the T-joint members may be closed with a cap 8*a*, 8*b* and 18*a*, 18*b*. The caps are secured to the T-joint members by placing an insert 40*a*, *b*, *c* or *d* between and into each T-joint member and cap. The use of these T-joint members with caps extends the rocking surface of the rocking chair and the ridges on T-joint members help make the rocking chair less prone to tipping.

From the upward opening on the T-joint members is inserted other tubular members 6*a* and 6*b*, 17*a* and 17*b*. Each of these members may be curved concavely inward in a similar method used to curve the rocking members 1*a* and 1*b* to provide increased stability to the rocking chair. On the upper end of the tubular members is mounted T-joint members 9*a* and 9*b*, 16*a* and 16*b* each having its side opening facing inward toward the opposite frame member. Between the front T-joint members 9*a* and 9*b* is a front seat tubular member 4 in the side openings. Likewise the side opening between the back T-joint members 16*a* and 16*b* is mounted a tubular member for the back of the seat.

In the top openings of each of the T-joint members 9*a*, 9*b* and 16*a* and 16*b* are mounted relatively short tubular members 10*a*, 10*b* and 15*a* and 15*b*. The length of these short members varies depending on the size of the rocking chair being constructed. On top of these latter front members 10*a* and 10*b* is an elbow joint member 11*a* or 11*b* with an opening facing toward the back of each frame. A fourth T-joint member 14*a* or 14*b* is mounted on the small back members 15*a* and 15*b*, each of said back members having a side opening facing the front elbows 11*a* and 11*b*. A tubular member 2*a* and 2*b* to form the arm of the rocking chair is inserted between the T-joint members 14*a* and 14*b* and the front elbows 11*a* and 11*b*. In the upper end opening of the T-joint members 14*a* and 14*b* is mounted a tubular member 13*a*, 13*b* having elbow joint members 12*a*, 12*b* mounted thereon with the openings facing each other between which are inserted a tubular headrest member 3.

Figure 7:
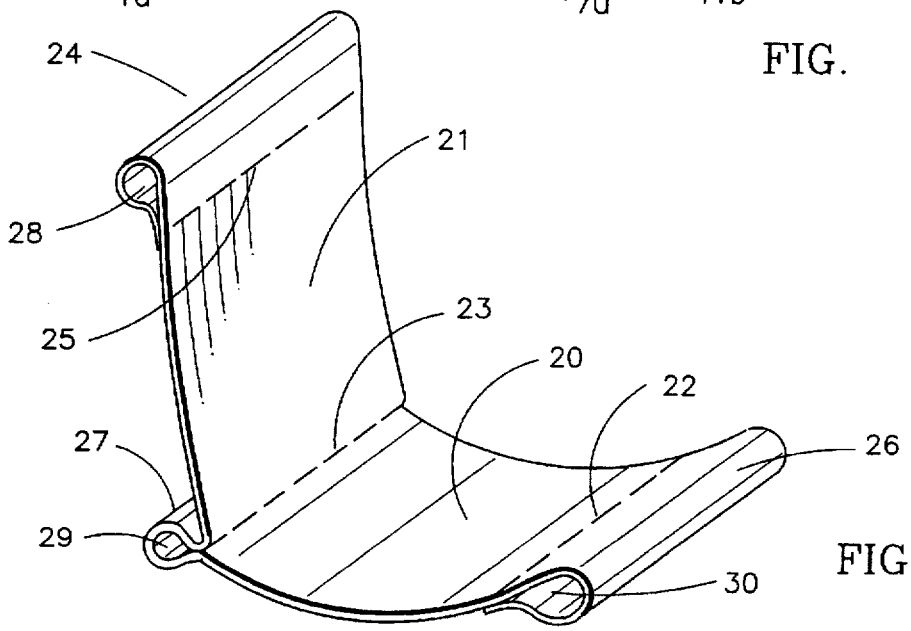
FIG. 7 is a perspective view of fabric seat in back by itself.

The above discussion has set forth the skeletal framework and construction of each rocking chair. The rocking chair would also have a seat 20 attached to the front tubular member 4 and back seat tubular member 5 and a back 21 attached between the back seat member 5 and headrest member 3 as illustrated in FIGS. 1 and 3. Although the seat 20 and back 21 could be attached by almost any means it would preferably have the embodiment shown in FIG. 7. In this embodiment the fabric forming the seat and back is doubled over to form folds 26, 27 and 24 along sew lines 22, 23 and 25, respectively, to form channels 30, 29 and 28, respectively, into which the tubular members 4, 5, and 3, respectively, could be inserted to hold the seat fabric firmly in place between the frames 40*a* and 40*b*.

Perhaps the best method of assembling the rocking chair would be to form each parallel side frame first then insert rails 3, 4 and 5 in the openings on one side, then slide the cloth seat onto the rails 3, 4 and 5 by inserting the rails through the channels and then attaching the second side frame to the three rails.

Even though a friction fit of the tubular members into the joint members would probably be sufficient to keep the members together maintain the rocking chair for use, an epoxy glue could be used to better secure the members within each joint member.

Furthermore even though a preferred embodiment of this invention may be made of separate members for easy disassembly and for more easily varying the size of the chair depending on the length of the tubular members used therein, the entire rocking chair could be made from an integral mold to form a one-piece chair.

Even furthermore, to make the chair easy to carry in luggage or ship by mail or other means, the members 3, 4 and 5 may be cut in half and joined by a PVC coupling before use.

It should be readily apparent that as described above the rocking chair of this invention provides a novel and non-obvious lightweight chair for easy carrying, particularly by a small child. Additionally, the present invention offers durability, resistance to the elements, safety and is less expensive than current rocking chairs.

Although only a few embodiments of the present invention have been described in detail hereinabove, all improvements and modifications to this invention within the scope or equivalents of the claims are covered by this invention.

Having thus described my invention, I claim:

1. A rocking chair comprising:

a pair of parallel side frames connected together and separated a select space by three tubular members, comprising a front seat rail member, a back seat rail member and a head rest rail member, each of said parallel side frames further comprising:

a curved tubular rocking member at a bottom of the side frame;

a first T-joint member attached to each end of the rocking member each T-joint member having a perpendicular top opening and an end opening;

upright lower tubular members secured in the top opening on each T-joint member;

a T-joint member attached to a top of each of said upright lower tubular members, each T-joint member having a top opening and a side opening directed perpendicular inward into which the tubular front seat rail member and back seat rail member, respectively, are inserted;

a tubular middle back member in the top opening of the T-joint member in the back of the frame;

a tubular middle front member in the top opening of the T-joint member in the front of the frame;

an elbow member inserted onto the top opening of the tubular middle front member with an opening directed toward the back of the frame;

a T-joint member attached to the tubular middle back member with a side opening directed perpendicularly toward the front elbow member and a top opening;

a tubular arm member between the side openings of the T-joint member in the front elbow member and the tubular back member;

an upright tubular member inserted in the top opening of the T-joint member on the tubular middle back member; and an elbow on the back upper member with an opening directed perpendicularly inward into which the head rail member can be inserted; and further comprising a seat connected between the front and back seat tubular members and a back connected between the back seat tubular member and the head rail member.

2. The rocking chair of claim 1 wherein the members are molded together to form an integral chair.

3. The rocking chair of claim 1 wherein the T-joint members on the rocking member have caps attached to the end openings by placing an insert into and between the T-joint members and caps.

4. The rocking chair of claim 3 wherein the members are molded together to form an integral chair.

5. The rocking chair of claim 3 wherein the upright lower tubular members are curved concave inward.

6. The rocking chair of claim 5 wherein the members are molded together to form an integral chair.

7. The rocking chair of claim 1 wherein the upright lower tubular members are curved concave inward.

8. The rocking chair of claim 7 wherein the members are molded together to form an integral chair.

9. The rocking chair of claim 1, 2, 3, 4, 5, 6, 7 or 8 wherein the members are made of polyvinylchloride.

* * * * *